US010583906B2

(12) United States Patent
Grez

(10) Patent No.: US 10,583,906 B2
(45) Date of Patent: Mar. 10, 2020

(54) AUTOMATICALLY RELEASING PIVOT CLAMP MODULE FOR AN OUTBOARD MOTOR

(71) Applicant: Joseph Grez, North Bend, WA (US)

(72) Inventor: Joseph Grez, North Bend, WA (US)

(73) Assignee: Joseph Grez, North Bend, WA (US)

( * ) Notice: Subject to any disclaimer, the term of this patent is extended or adjusted under 35 U.S.C. 154(b) by 0 days.

(21) Appl. No.: 16/109,540

(22) Filed: Aug. 22, 2018

(65) Prior Publication Data

US 2019/0061897 A1 Feb. 28, 2019

Related U.S. Application Data

(60) Provisional application No. 62/550,391, filed on Aug. 25, 2017.

(51) Int. Cl.
*B63H 20/10* (2006.01)
*B63H 20/08* (2006.01)

(52) U.S. Cl.
CPC ..... *B63H 20/10* (2013.01); *B63H 20/08* (2013.01)

(58) Field of Classification Search
CPC ..... B63H 20/00; B63H 20/007; B63H 20/02; B63H 20/08; B63H 20/14; B63H 20/32; B63H 21/00; B63H 21/17; B63H 20/10; B63H 20/12; B63H 20/06
USPC ..... 440/55, 63
See application file for complete search history.

(56) References Cited

U.S. PATENT DOCUMENTS

| | | | | | |
|---|---|---|---|---|---|
| 3,785,329 | A * | 1/1974 | Shimanckas | B63H 20/10 | 440/55 |
| 3,835,807 | A * | 9/1974 | Kueny | B63H 20/08 | 440/55 |
| 3,902,449 | A * | 9/1975 | Berry | B63H 20/08 | 440/55 |
| 4,759,733 | A * | 7/1988 | Nishimura | B63H 20/10 | 440/55 |
| 4,826,459 | A * | 5/1989 | Slattery | B63H 20/08 | 440/55 |
| 5,096,447 | A * | 3/1992 | Uehara | B63H 20/10 | 440/55 |
| 5,669,794 | A * | 9/1997 | Knight | B63H 20/007 | 440/63 |
| 8,597,066 | B2 | 12/2013 | Grez | | |
| 2012/0064783 | A1 | 3/2012 | Grez | | |
| 2014/0008512 | A1 | 1/2014 | Grez | | |

* cited by examiner

*Primary Examiner* — Lars A Olson
(74) *Attorney, Agent, or Firm* — Clark A. Puntigam; Jensen & Puntigam, P.S.

(57) ABSTRACT

The assembly includes a pivoting body member connectable to an outboard motor assembly, wherein the pivoting body member is movable along a transition path having a locked condition endpoint and an unlocked condition endpoint. A pivoting latch seat mechanically cooperates with a fixed latch pin in the assembly to maintain the pivoting latch seat and the outboard motor assembly in a locked condition when the outboard motor assembly is in a lowered position. The pivoting latch seat is mounted and arranged to disengage from the fixed latch pin to an unlocked condition when the pivoting body member is moved along the transition path to the unlocked condition endpoint, thereafter permitting movement of the outboard motor assembly to a raised position.

13 Claims, 16 Drawing Sheets

AUTOMATICALLY RELEASING PIVOT CLAMP MODULE FOR AN OUTBOARD MOTOR

TECHNICAL FIELD

This invention relates generally to outboard motors, and more specifically to a pivot clamp module for an outboard motor.

BACKGROUND OF THE INVENTION

The focus is outboard motors of smaller size—usually below 10 HP and where typical use applies to small craft of lengths generally 6 to 25 ft where and especially where care is needed to prevent unstable conditions that might arise from moving one's weight to the near proximity of the outboard motor, or by twisting one's body to reach parts of the outboard motor. Canoes and kayaks are longer craft that due to their narrow beam are subject to stability problems from such crew movements. Smaller craft of length 12 ft and under, and of a typical width, are also subject to stability impacts from shifting crew weight. Finally, most smaller boats that use motors have the motor mounted on or near the stern— the rear end of the craft. If the crew moves aft to manage the motor operation, than weight on the stern both makes the boat less efficient to propel and causes handling problems in windy conditions. Finally, moving one's weight to the rear of the craft to manipulate latches, or to turn the motor around, depending on the specific craft and sea conditions, can decrease freeboard, inviting a swamping or sinking outcome. So in short, it is important to safety, comfort, efficiency and control to maintain crew in a stable position in a boat and located so that their weight maintains proper trim.

Selecting reverse will cause a motor to pivot up to the rear, and out of the water by means of the reverse thrust from the propeller. When this happens, reverse thrust is lost and/or unsafe in-air rotating propeller conditions exist. So motors that have reverse all have some means of latching the motor in the lowered position to prevent unintentional raising of the motor. Outboard motors that have a reverse function all currently require the operator to move close to the motor, either for lifting and lowering the motor, or for selecting reverse by turning the motor around to operate backwards. Some motors without reverse do not, but then the benefits of having a reverse function are lost.

Outboard motors are generally designed to tilt from an in-use position where the propeller is immersed, to a lifted position where the propeller is raised. The action of raising the motor to a lifted position is usually accomplished by releasing a latch proximal to the clamp, reaching to the rear of the motor housing and pulling to lift, especially for motors fitted with a reverse capability. Once in a lifted position, another latch, or the same latch if it is a dual-purpose latch, maintains the lifted position. To lower the motor, another latch or the same dual purpose latch near the clamp is released by hand, and the motor housing is pushed until the propeller end is properly immersed for operation. In these instances, it is required that the user access the motor housing and release latches which may require them to move to the end of the boat where the motor is mounted.

Some outboard motors have no means of latching the motor in the upright or lowered position. But these motors have no reverse function and they require the user to reach back to the motor housing to heave the motor to a lifted condition or to push the motor to a lowered position.

Some outboard motors similarly have no means of latching the motor in the upright or lowered position and limited reverse functionality. In this instance, a geometrical relationship between the motor pivot point and the tiller pivot allows the motor to be lowered to an immersed position by pushing on the tiller, and allows the user to raise the motor by pulling on the tiller arm (see U.S. Pat. No. 8,597,066, US20120064783, US20140008512), allowing the user to remain in a safe seated position while operating the tilt functions of their motor. These motors may have a reverse function by employing a spring latch that releases at some force level. However this limits the reverse thrust to a level quite low; since the distance from the pivot point to the propeller is large compared to the distance from the pivot point to the spring latch. So the force resistance of the spring latch must be proportionally higher than the reverse thrust. This makes the torque required to raise the motor quite high in practice. For example, if the distance from the pivot to the propeller is 15 inches (a normal short shaft motor) and the distance from the pivot to the spring latch is 5 inches, than a 10 lb reverse thrust equates to a 30 lb latch requirement. Assuming the acting radius of the tiller arm pivot solution in U.S. Pat. No. 8,597,066 is also 5 inches, that would require a 30 lb pull on the tiller arm to release the spring latch. This is a high force requiring a significant amount of effort.

In some instances, reverse is selected by rotating the motor 180 degrees which redirects the thrust backwards. In this cases, the motor shaft engages a hook when rotated to prevent raising when deployed for reverse. This hook releases when the motor is again turned around to the forward position allowing the motor to raise as needed without manipulation of another latch. However, this solution requires the user to sit very close to the motor to rotate the motor for reverse, and even these motors generally do not allow raising and lowering by pulling and pushing on the tiller arm and therefore can cause instability as described in scenarios above.

In some instances reverse is actuated by a twist of the throttle or changing of a direction selection lever on the motor. In these instances, the motor has no need to be twisted around for reverse. However, a latch is required in order to keep the motor in a lowered position against the rearward thrust of the propeller. So these motors typically have two latch positions, one where the reverse resistance feature is enabled, and one where it is disabled enabling a "kick-up" mode. Before beaching a boat fitted with such a motor it is necessary to remember to place this latch in a kick-up mode.

For other cases, such as commonly employed in trolling motors, the motor is latched its position at all times unless a latch is manually held in a release position. With such solutions there is a risk of the motor remaining in a latched down position when encountering the beach or underwater obstructions and the result can be sudden instability, sudden stops causing people to be thrown forward, damage to the motor or damage to the boat where the motor is mounted.

SUMMARY OF THE INVENTION

Accordingly, the invention is an assembly for moving an outboard motor assembly, mountable on a boat by a clamping module, between a lowered position and a raised position, comprising: a pivoting body member connectable to an outboard motor assembly, wherein the pivoting body member is movable along a transition path having a locked condition endpoint and an unlocked condition endpoint; and a pivoting latch seat mechanically attached to the pivoting body member and mechanically cooperating with a fixed latch pin in the assembly to maintain the pivoting latch seat and the outboard motor assembly in a locked condition when the outboard motor assembly is in a lowered position, wherein the pivoting latch seat is mounted and arranged to disengage from the fixed latch pin to an unlocked condition when the pivoting body member is moved along the transition path to the unlocked condition endpoint, thereafter permitting movement of the outboard motor assembly to a raised position.

BEST MODE FOR CARRYING OUT THE INVENTION

Figure 1:
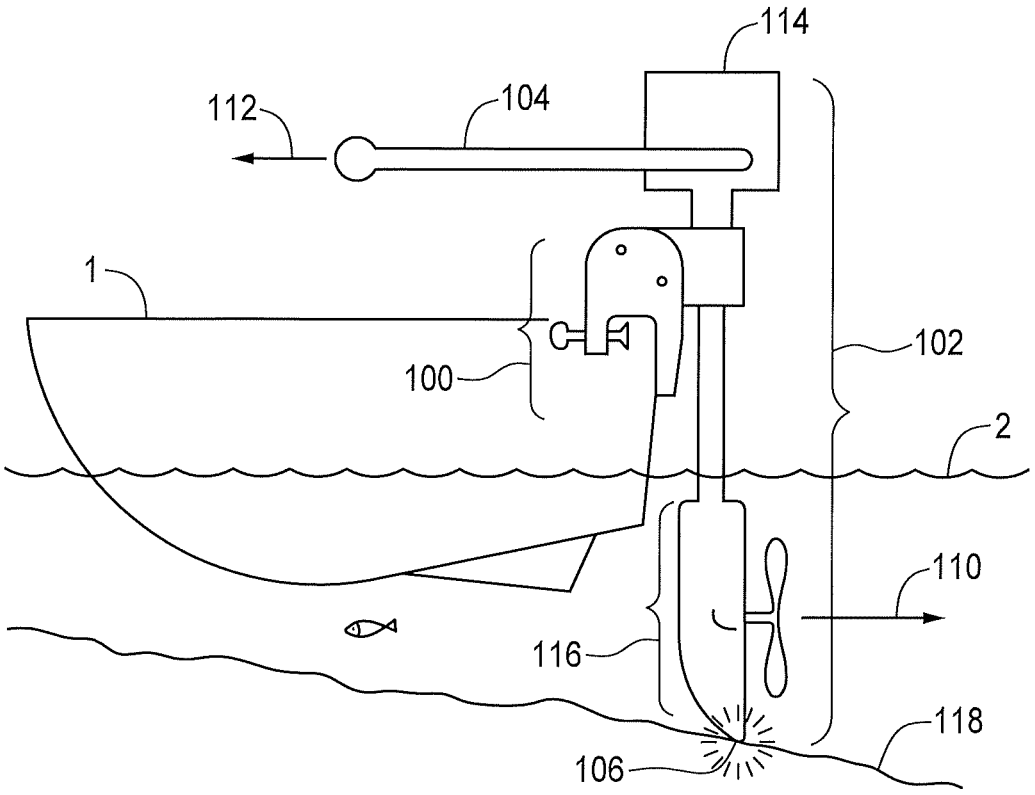
FIG. 1 is an elevational view showing a boat with an outboard motor sitting in the water and showing a ground surface as well.

FIG. 1 generally shows a boat 1 sitting in the water 2 with an outboard motor 102 a tiller arm 104 connected to a motor head 114, a lower unit with propeller 116, the bottom below the water, 118, a grounding incident or contact 106, a clamp and pivot module 100.

Figure 2:
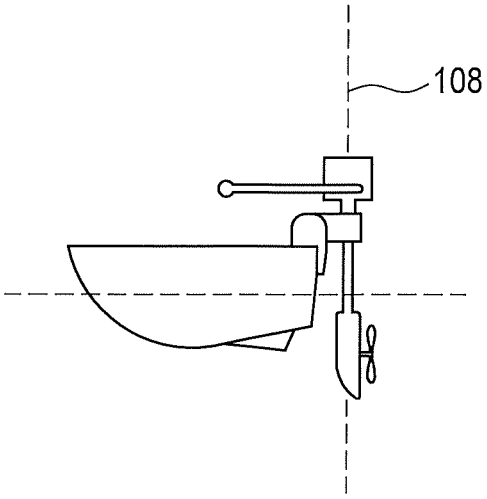
FIG. 2 is an elevational view showing the outboard motor of FIG. 1 in a lowered position.

FIG. 2 shows the motor module in a lowered position 108

Figure 3:
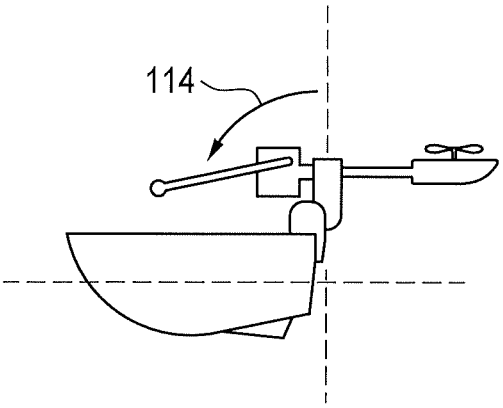
FIG. 3 is an elevational view showing the outboard motor of FIG. 1 in a raised position.

FIG. 3 shows the motor module in a raised position 114.

Figure 4:
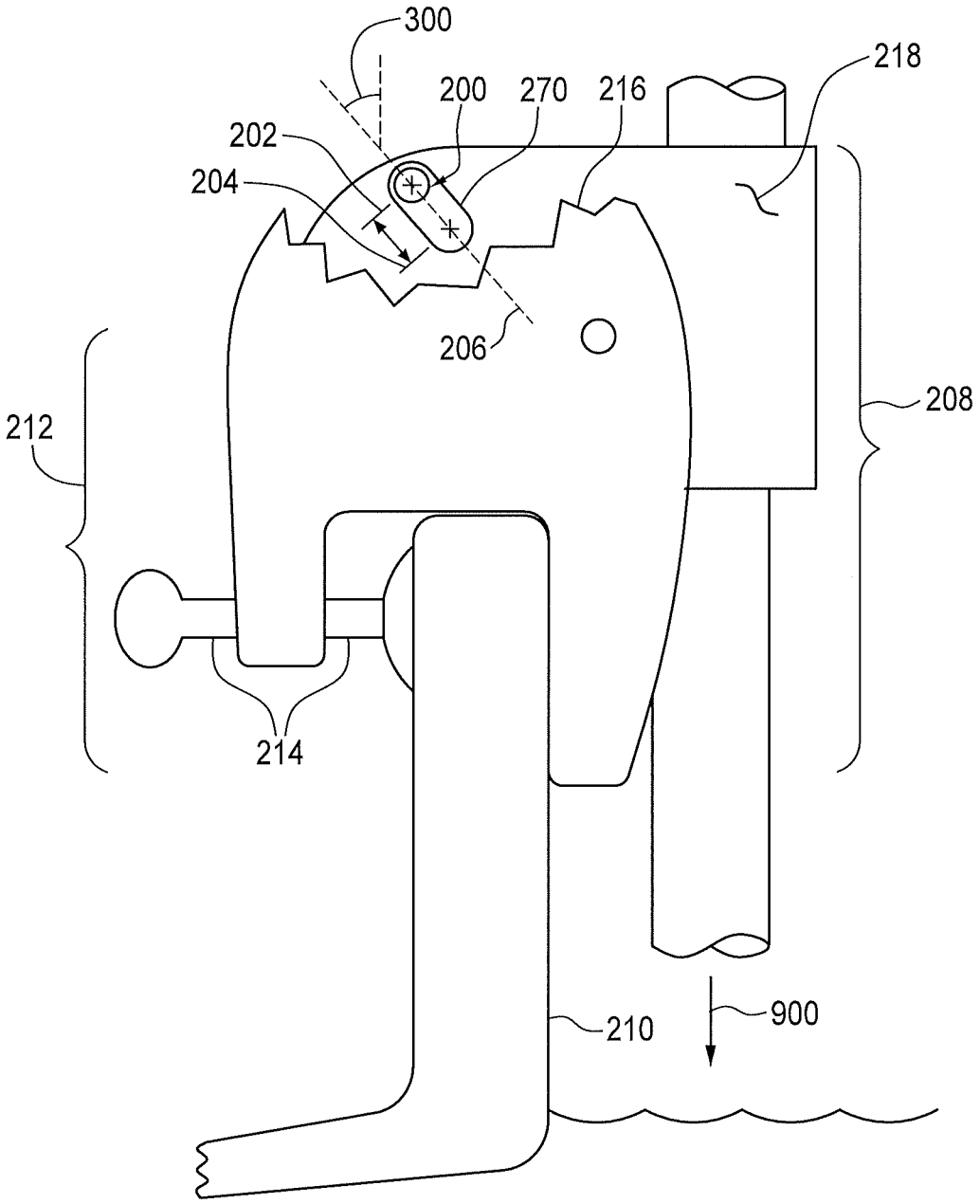
FIG. 4 is a partially cutaway elevational view showing a clamp and pivot module combination for an outboard motor.

FIG. 4 shows a clamp and pivot module 208 attached to a boat transom 210, with a cut-away section 216 of a clamp module 212, clamp screw 214, pivot module 218, and mechanical elements relevant to the operation of the pivot function including transition path 206, endpoints 204 and 202, pivot point 200, pivot path tilt 300 with the pivot module resting by force of gravity so that the pivot point 200 is at the top of the slot 220 which is a locked position that prevents pivoting of the pivot module and motor module.

Figure 5:
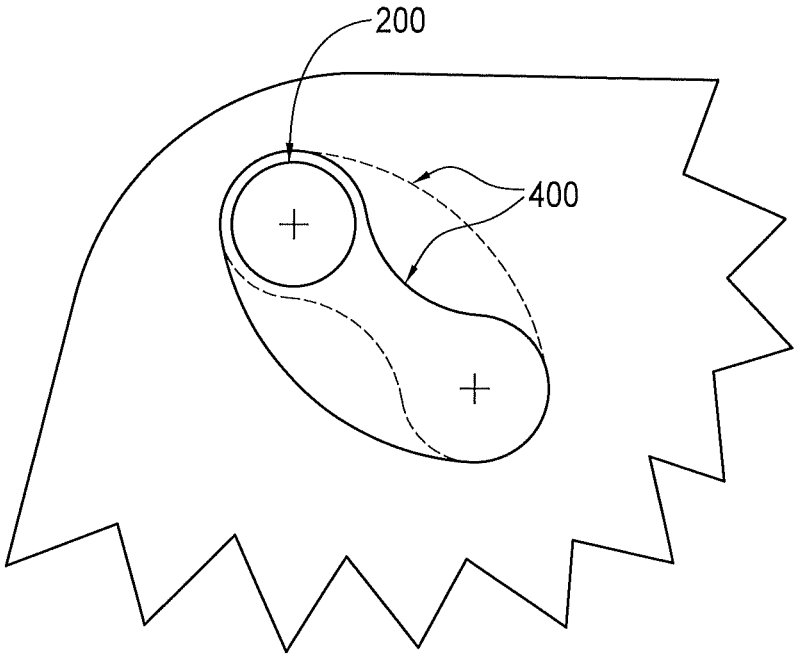
FIG. 5 is a view showing radiused transition path examples for the pivot function of the pivot module portion of the clamp and pivot module combination.

FIG. 5 shows radiused transition paths 400, one curving upward (solid line) and the other curving downward (dotted line)

Figure 6:
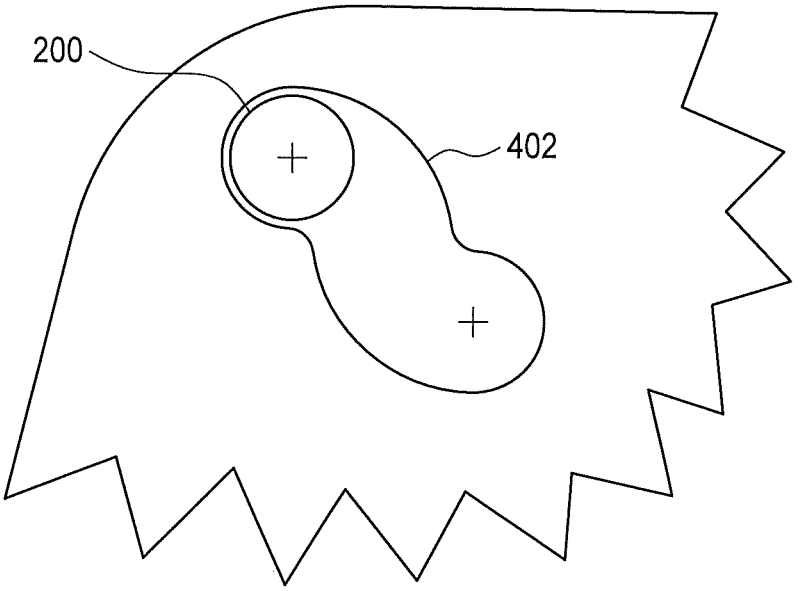
FIG. 6 shows a complex transition path.

FIG. 6 shows a complex transition path 402.

Figure 7:
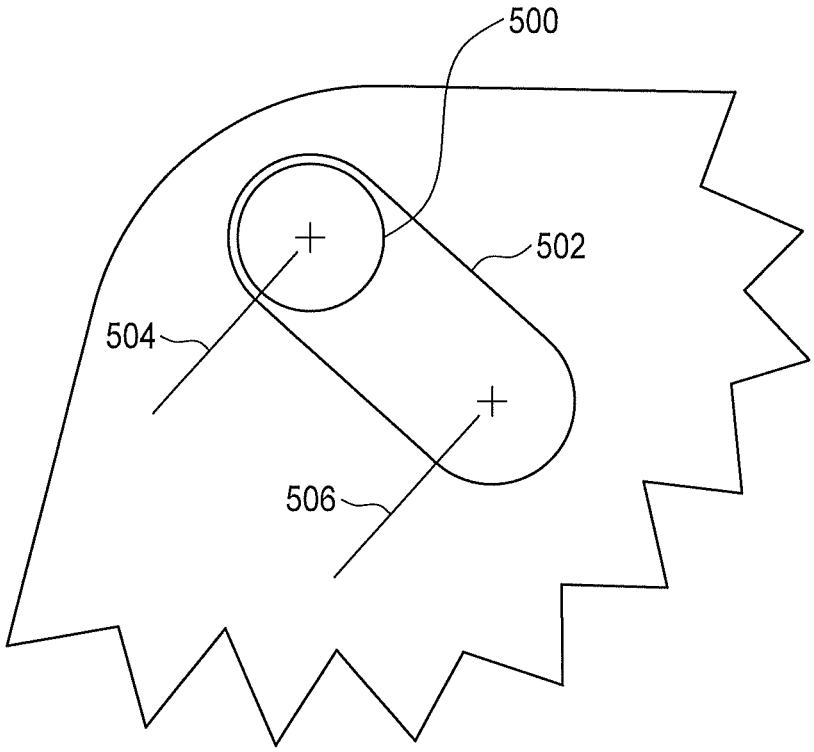
FIG. 7 shows a pivot and slot arrangement defining a transition path for the pivot module.

FIG. 7 shows a pin 500 and slot 502 arrangement to provide a transition path and endpoints 504 and 506.

Figure 8:
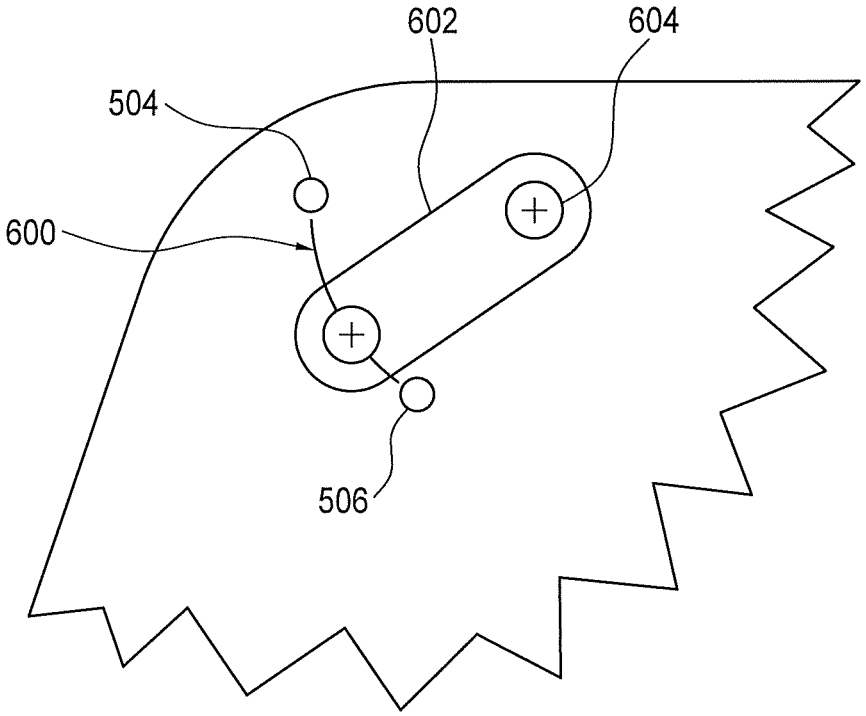
FIG. 8 shows a pivot linkage defining an arcuate path for the pivot module.

FIG. 8 shows a pivoting linkage pivoting about point 604 describing an arc path 600 with end stops 504 and 506.

Figure 9:
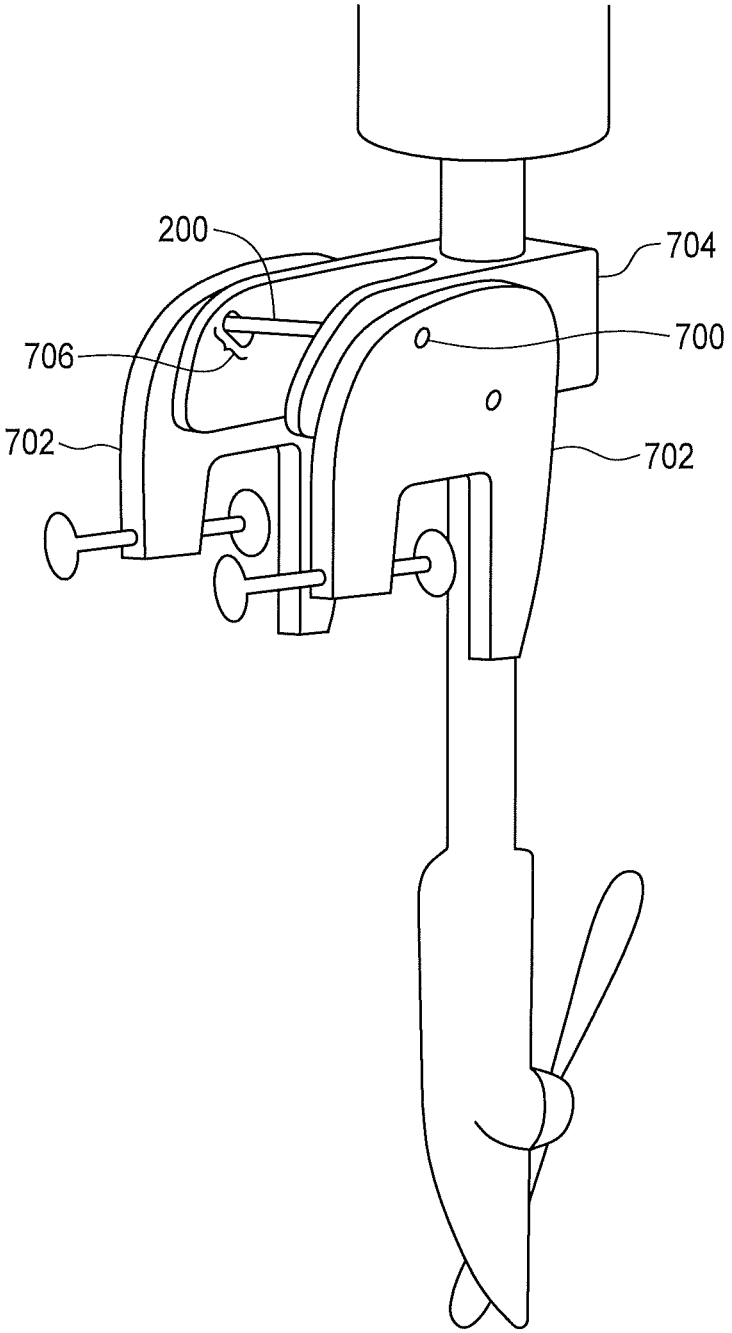
FIG. 9 is an elevational view showing one embodiment of the clamp and pivot module combination.

FIG. 9 shows one option for placement of transition/endpoint features 706 on the pivot module 704, and a fixed pivot point 200,700 on the clamp module 702.

Figure 10:
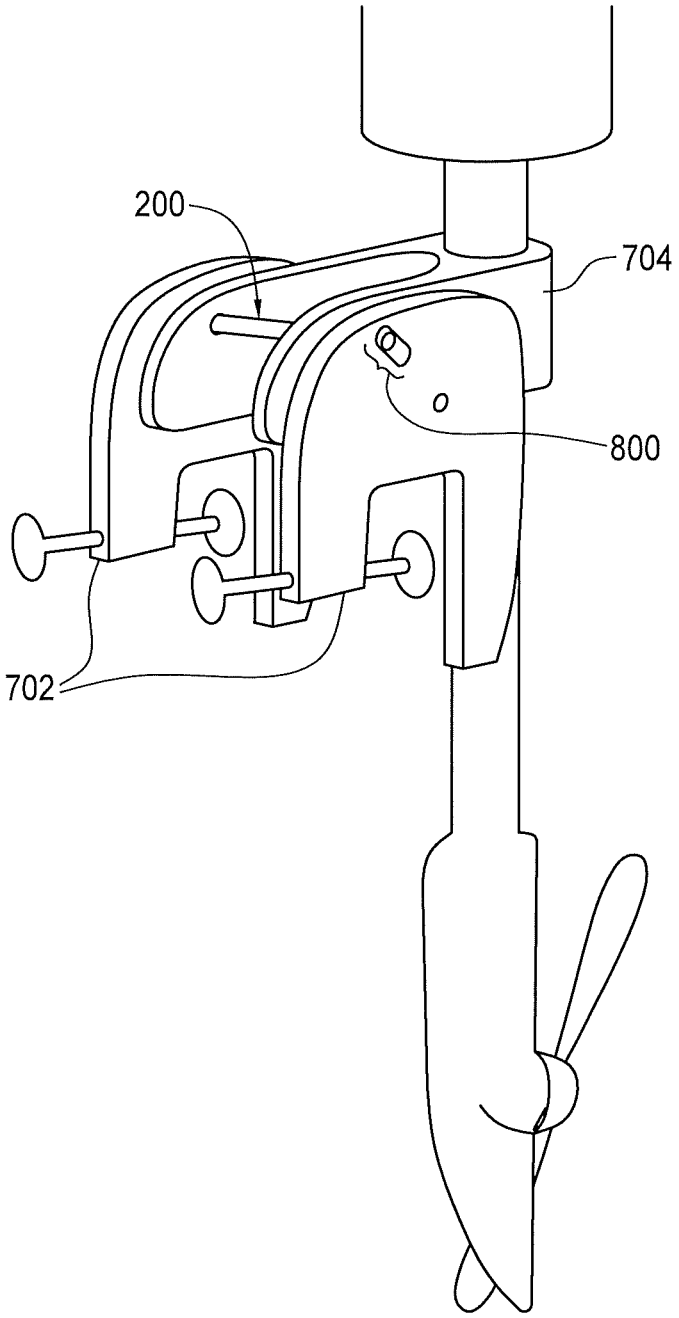
FIG. 10 is an elevational view showing another embodiment for the clamp and pivot module combination.

FIG. 10 is another option whereas the transition/endpoint feature 800 is on the clamp module 702 and the fixed pivot point 200 is on the pivot module 704.

Figure 11:
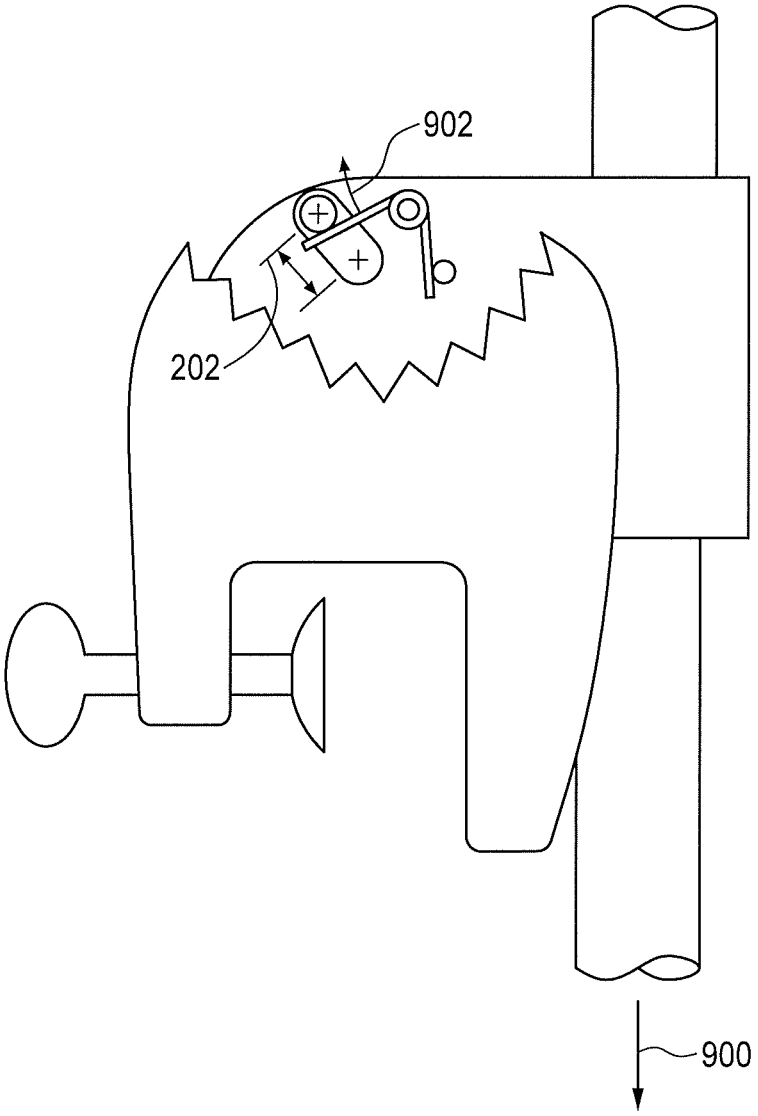
FIG. 11 is a partially cutaway view of the clamp and pivot module combination showing two possible arrangements for a locked pivot point.

FIG. 11 shows two possible means of establishing a locked pivot point position 202, one using a spring force 902, and one using gravity 900.

Figure 12:
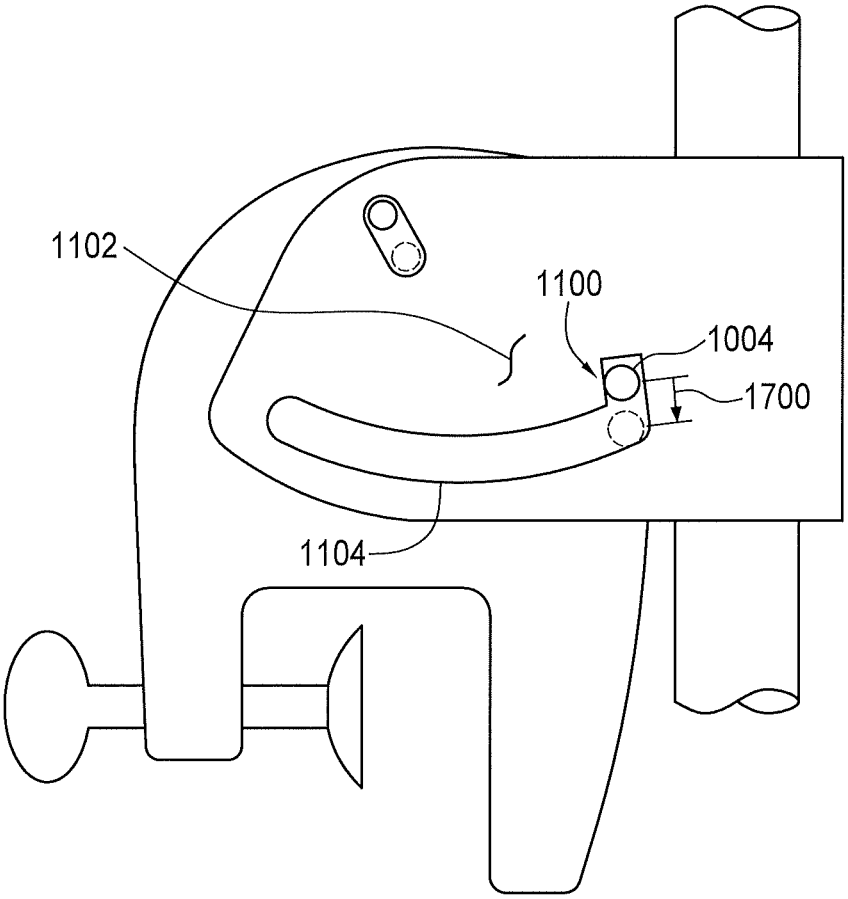
FIG. 12 is an elevational view of an alternative pivot module embodiment.

FIG. 12 shows a pivot latch option with no moving parts generally shown at 1102 whereas a clearance slot 1104 for the latch rest pin 1004 contains a latch seat 1100 that prevents pivoting unless the motor is raised to the dotted positions indicated.

Figure 13:
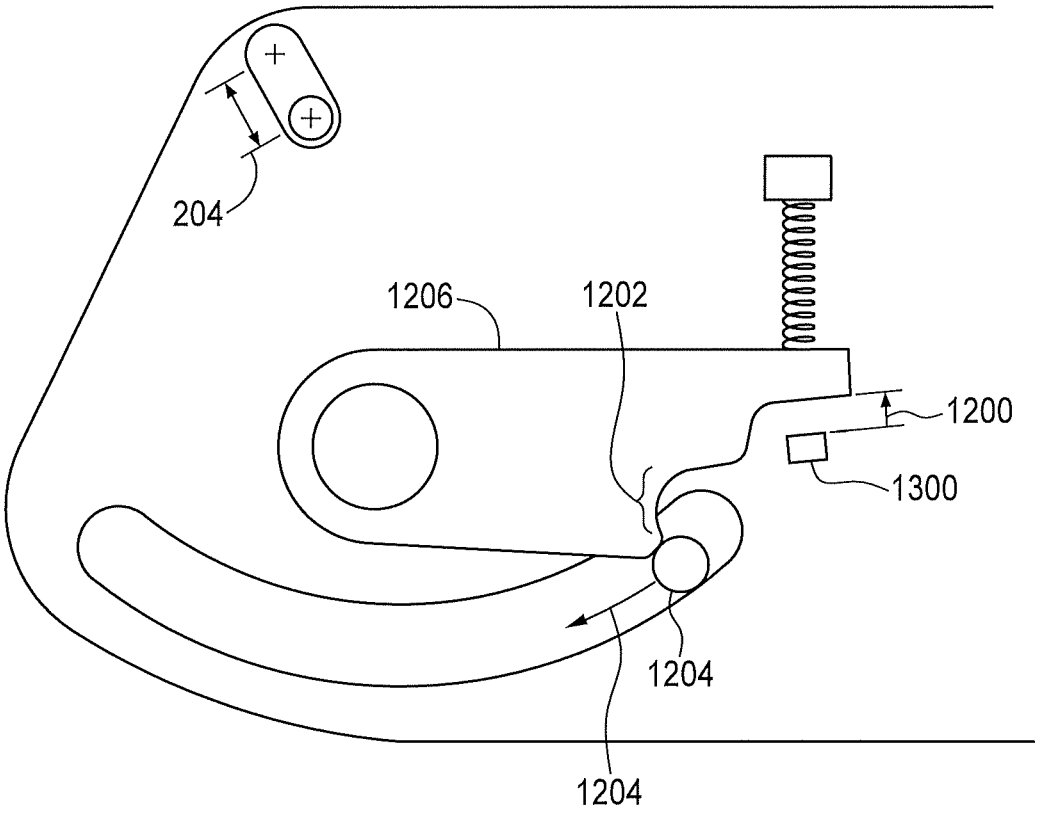
FIG. 13 is an elevational view showing a pivot module latch in an unlocked position.

FIG. 13 shows a moveable pivot latch 1206 with pivot prevention seat 1202 having moved some distance 1200 allowing the latch rest pin 100 is partially free to transverse 1204 in its slot.

Figure 14:
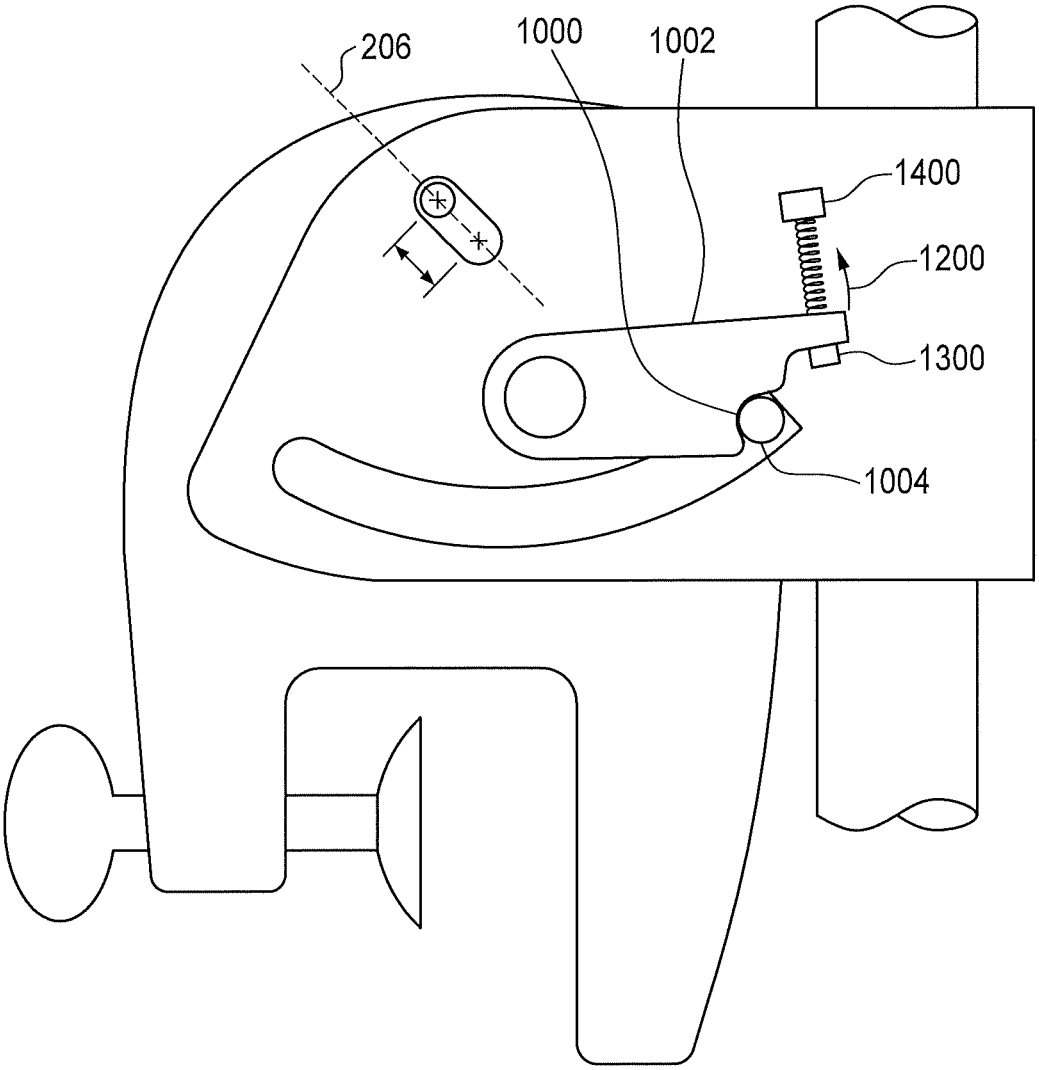
FIG. 14 is an elevational view showing the pivot module latch of FIG. 13 in a locked position.

FIG. 14 shows the same concept in a latched position with the pivot point in the locked position 202, the transition path 206, pivot latch 1002, latch rest pin 1004 in position in the pivot latch seat 1000 where the pivot latch is also resting on its stop 1300 to prevent a lower extension during a locked-to-unlocked transition and spring and spring seat 1400 that returns the latch to a locking condition after the motor has been lowered.

Figure 15:
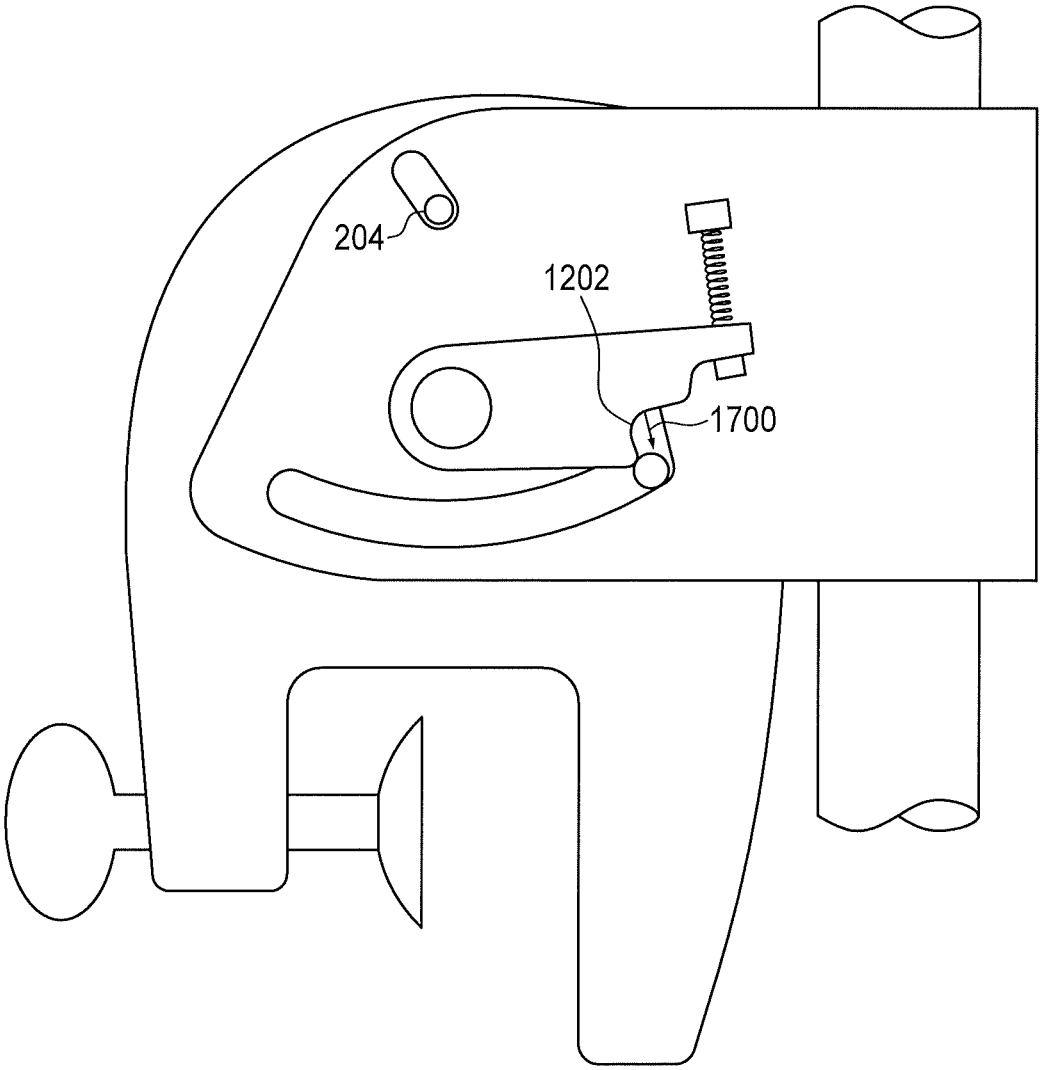
FIG. 15 is an elevational view showing the pivot latch of FIGS. 13 and 14 in a transition position, permitting movement of the pivot module.

FIG. 15 shows the pivot latch at a transition point whereas the unlatched pivot position 204 has enabled the latch rest pin to unseat itself 1700 from the latch seat 1202 so that further forward motion of the rest stop pin can spring the pivot latch out of its path.

Figure 16:
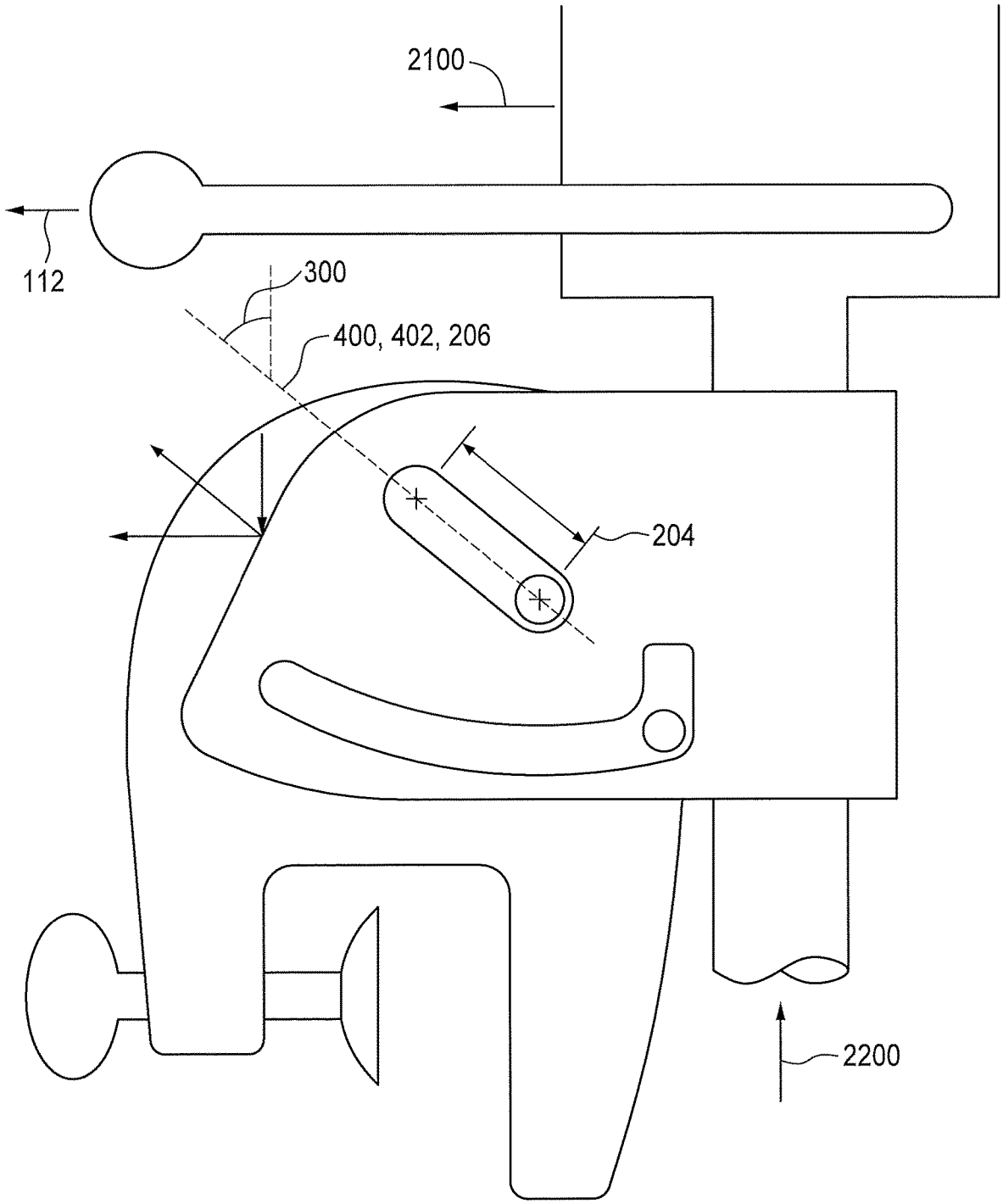
FIG. 16 is an elevational view showing a transition from a locked latch position to an unlocked position with the angle of the transition path.

FIG. 16 shows how a tension in the tiller arm 112 and forward momentum of the motor module against a deceleration of the watercraft 2100 can work to create a transition from a locked position to an unlocked position 204 by virtue of the forward angle 300 of the transition path 400,402,206. It also shows that an upward component of force 2200 that would result from grounding a vessel on the motor module can also force an unlock transition.

Figure 17:
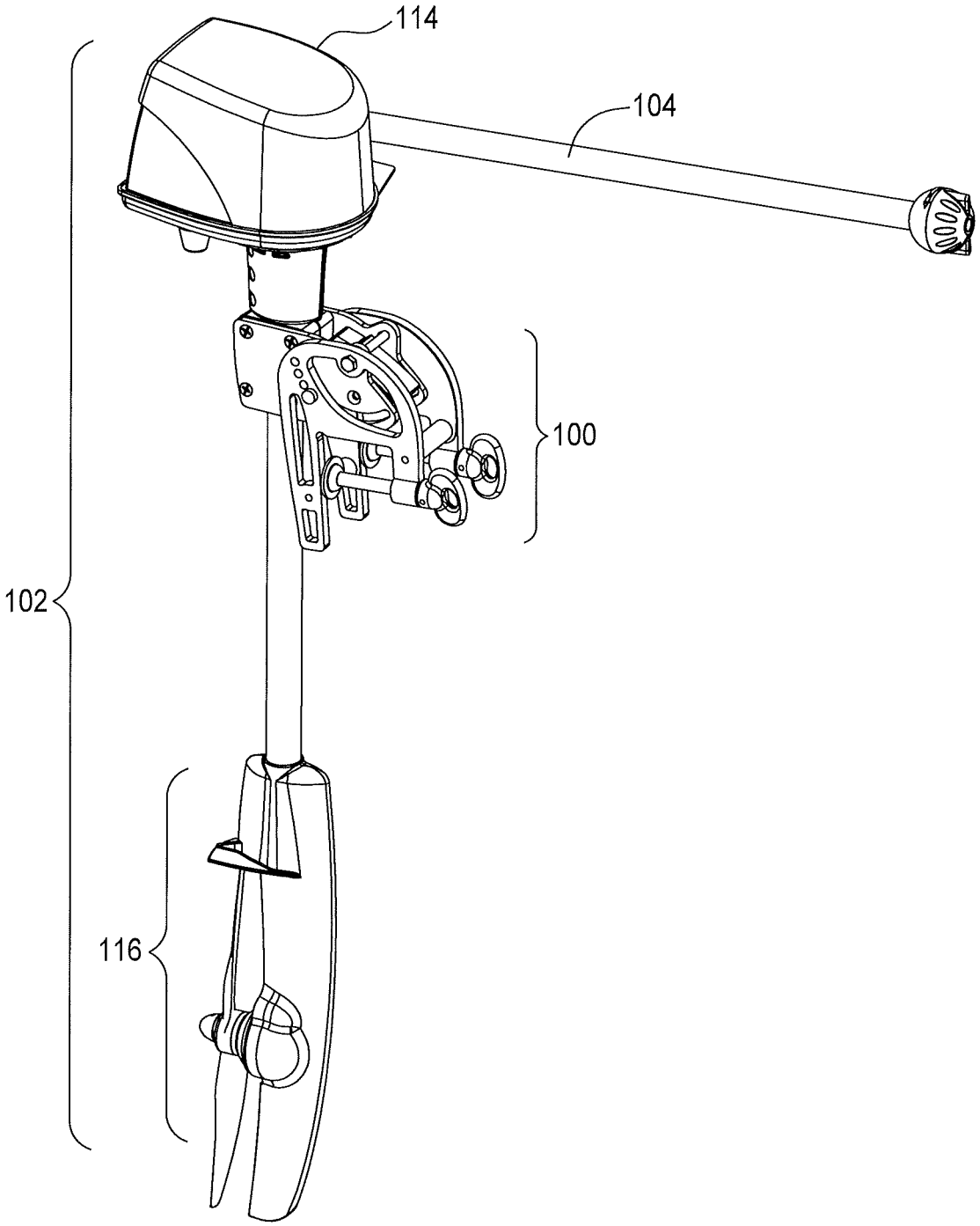
FIG. 17 is a see-through perspective view showing the clamp and pivoting module combination mounted on an outboard motor.
Figure 18:
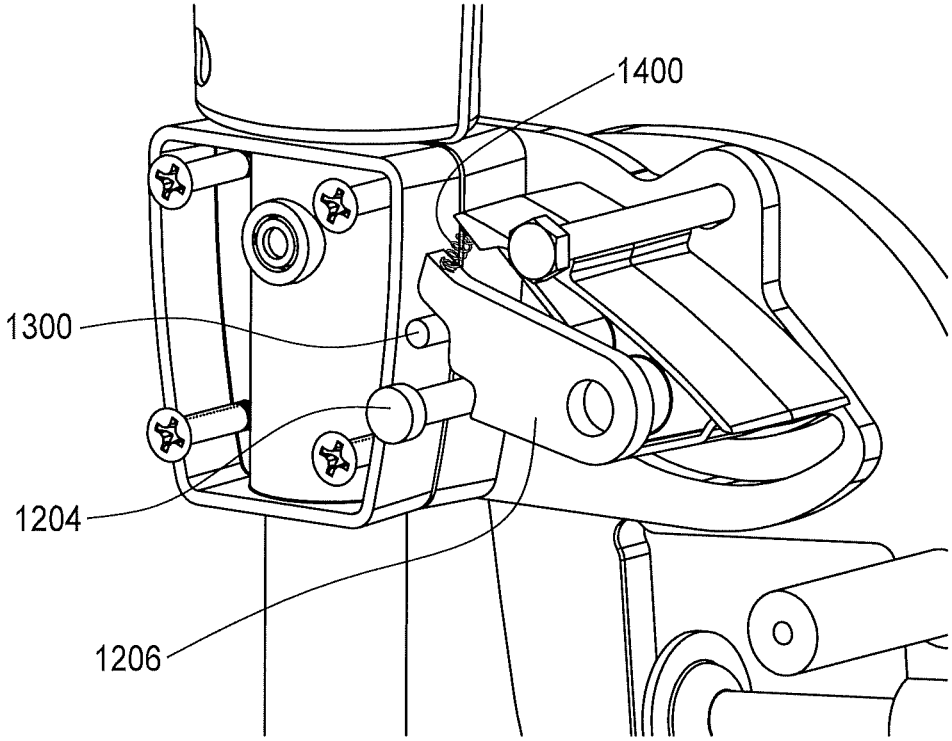
FIG. 18 is a see-through view showing the clamp and pivoting module combination with a latch seat.

FIG. 17 shows an outboard motor with a clamping module, a pivoting body member and a pivoting latch member, with some parts in see-through so that the assembly as a whole can be better visualized FIG. 18 shows a close up view of a portion of FIG. 17.

Figure 19:
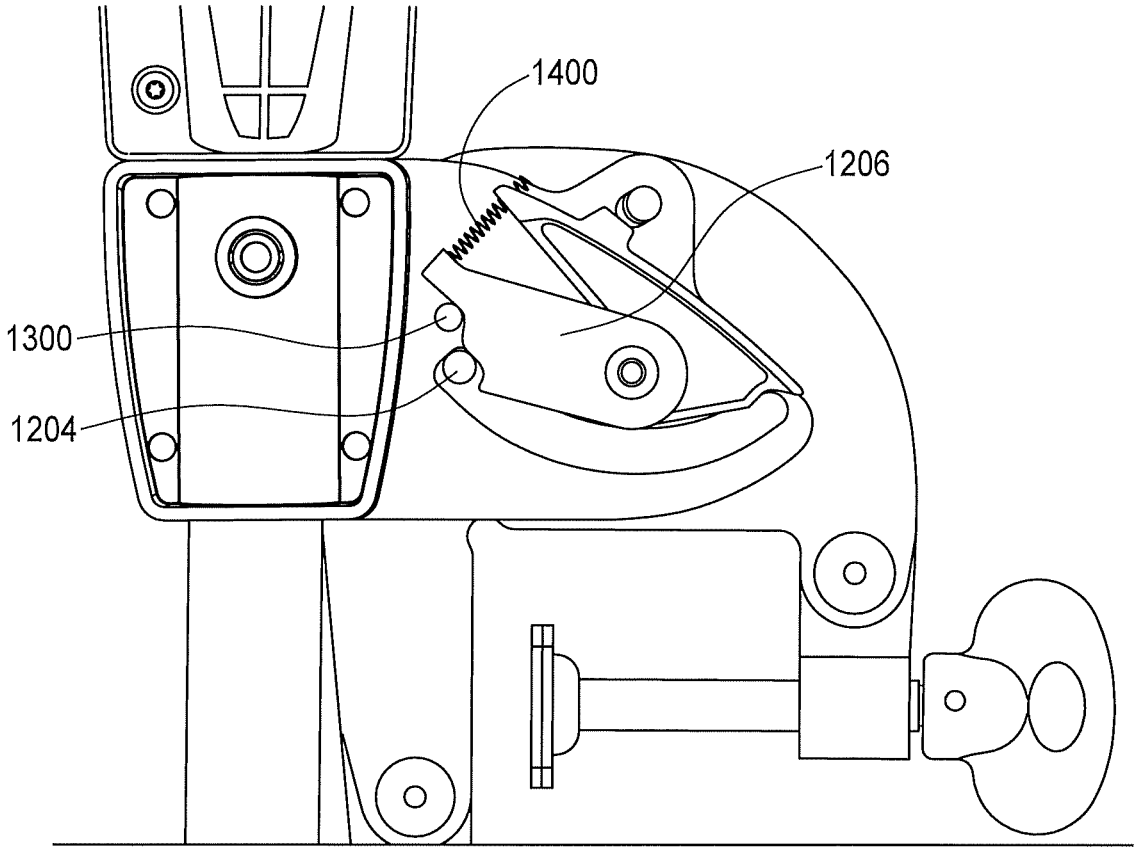
FIG. 19 is an elevational view showing the latch seat arrangement on the pivoting module.

FIG. 19 shows a portion of FIGS. 17 and 18, somewhat simplified.

Referring to FIGS. 1-3, a mechanical tilt pivot and clamp module 100 is shown or an outboard motor 102 that requires no manual input to tilt the motor to a raised position aside from pulling on the tiller-arm 104 or from grounding contact 106, and wherein the motor remains locked in a lowered position 108 against a level of reverse thrust 110 equal to or greater than the tension in the tiller arm 112 required to tilt the motor to a raised position 114.

In FIG. 4, tilt pivot point 200 can translate along path 206 between two end positions; a locked position 202 and an unlocked position 204.

The tilt pivot point transition path 206 is angled forward 300 between 10 and 80 degrees from a vertical line.

The pivot point transition path is curved 400 in FIG. 5 or complex 402 in FIG. 6.

The transition path is provided by a pin 500 in a slot 502 with fixed end points 504, 506, as shown in FIG. 7.

In FIG. 8, the transition path 600 is provided by a linkage 602 with end stops 604, 606.

A shown in FIG. 9, the pivot point 200 is fixed 700 in the clamp 702 and the pivot module 704 contains the endpoints and transition path 706.

In FIG. 10, the fixed pivot point 200 is fixed in the pivot module 704 and the clamp 702 contains the endpoints and transition path 800.

Referring to FIG. 11, one endpoint position is a locking position 202 resulting from the downward weight of the motor module 900, or from a spring force 902.

The locking position 202 in FIG. 14, also shown in FIG. 4, locates a seat 1000 in the pivot latch 1002 to a latch rest pin 1004 so that the latch rest pin is seated on the pivot In FIG. 12, the pivot latch seat 1100 is immovable, being a feature 1102 in the pivot assembly.

The pivot latch 1206 in FIG. 13 is moveable 1200 so that after un-seating the latch rest pin from the seat 1202, the latch pin no longer hinders movement 1204 of the pivot module from moving through an arc unhindered by the pivot latch.

Referring again to FIG. 14, the pivot latch has a rest 1300 to prevent hyper-extension during reverse The pivot latch has a spring 1400 to return it to its rest position All pins referenced are a bolt, screw, dowel pin, protrusion in mating parts that forms a pivot or resting action as described.

The second endpoint position is an unlocked position 204 resulting from the raising of the motor module against gravity 900 or against a spring force 902, as shown in FIG. 11.

The unlocked position 204, in FIG. 15 dislocates the seat in the pivot latch 1202 from the latch rest pin 1004, FIG. 13, either completely 1700 or partially.

In the case of a complete dislocation, the latch rest pin is unencumbered by the seat allowing the pivot module and motor module to pivot.

In the case of a partial dislocation, the latch rest pin can move the pivot latch, as shown in FIG. 13, 1200 allowing the pivot module and motor module to pivot.

As shown in FIG. 16, tension at 112 applied to the tiller arm forces a transition to an unlocked endpoint 204 as a result of the forward slant 300 of the pivot point transition path 400,402,206.

The raising of the motor to the unlocked endpoint results from the forward inertia 2100 of the motor against a backward acceleration of the watercraft The raising of the motor to the unlocked endpoint results from an upward component of force on the motor module imposed by grounding 106, as shown in FIG. 1, in shallow water.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A mechanical control assembly for moving an outboard motor assembly, mountable on a boat by a clamping module, between a lowered position and a raised position, comprising:

a pivoting body member connectable to an outboard motor assembly, wherein the pivoting body member is movable along a transition path having a locked condition endpoint and an unlocked condition endpoint; and a pivoting latch seat mechanically attached to the pivoting body member and mechanically cooperating with a fixed latch pin in the mechanical control assembly to maintain the pivoting latch seat and the outboard motor assembly in a locked condition when the outboard motor assembly is in a lowered position, wherein the pivoting latch seat is mounted and arranged to disengage from the fixed latch pin to an unlocked condition when the pivoting body member is moved along the transition path to the unlocked condition endpoint, thereafter permitting movement of the outboard motor assembly to a raised position.

2. The mechanical control assembly of claim 1, including a spring member for returning the pivoting latch seat to the locked condition when the outboard motor assembly is returned to the lowered position from a raised position.

3. The mechanical control assembly of claim 2, wherein the spring member extends between a point on the pivoting body member and the pivoting latch seat and wherein the spring member compresses when the outboard motor assembly is moved to the raised position.

4. The mechanical control assembly of claim 1, wherein the pivoting body member is moved along the transition path by action on a tiller portion of the outboard motor assembly by an operator.

5. The mechanical control assembly of claim 1, wherein the pivoting body member is moved along the transition path to the unlocked condition endpoint by a grounding action of the outboard motor assembly.

6. The mechanical control assembly of claim 1, wherein the pivoting latch seat pivots about a latch seat pin mounted on the pivoting body member.

7. The mechanical control assembly of claim 1, wherein the mechanical control assembly includes a clamping module which includes two spaced clamp members, and wherein the pivoting body member is positioned between the clamp members, the mechanical control assembly including a pivot pin which extends between the two clamp members and through an opening in the pivoting body member defining the transition path.

8. The mechanical control assembly of claim 7, wherein the fixed latch pin extends from a clamp member.

9. The mechanical control assembly of claim 1, wherein the pivoting body member includes a pair of opposed plates joined at end portions thereof to define a connecting portion, the connecting portion having an opening through which a depending element of the outboard motor assembly extends, wherein the pivoting latch seat is positioned adjacent an inner surface of one of the opposed plates, wherein the one plate includes a curved opening through which the fixed latch pin extends, wherein the fixed latch pin is located at a proximal end of the curved opening when the outboard motor assembly is in the lowered position and is at approximately a distal end of the curved opening when the outboard motor assembly is in the raised position.

10. An mechanical control assembly for moving an outboard motor assembly, mountable on a boat by a clamping module, between a lowered position and a raised position, comprising:

a pivoting body member connectable to an outboard motor assembly, wherein the pivoting body member is movable along a transition path having a locked condition endpoint and an unlocked condition endpoint;

wherein the transition path is defined by a curved opening in the pivoting body member, the curved opening having a latch seat portion at a proximal end thereof through which a fixed latch pin in the mechanical control assembly extends, the latch seat portion mechanically cooperating with the fixed latch pin to maintain the pivoting body member and the outboard motor assembly in a locked condition when the outboard motor assembly is in a lowered position; and wherein the latch seat portion is configured so that the latch seat portion disengages from the latch pin when the pivoting body member is moved along the transition path to the unlocked condition endpoint, thereafter permitting movement of the outboard motor assembly to the raised position.

11. The mechanical control assembly of claim 10, wherein the pivoting body member is moved along the transition path to the unlocked condition endpoint by a grounding action of the outboard motor assembly.

12. The mechanical control assembly of claim 10, wherein the mechanical control assembly includes a clamping module which includes two spaced clamp members, and wherein the pivoting body member is positioned between the clamp members and includes a pivot pin which extends between the two clamp members and through an opening in the pivoting body member defining the transition path.

13. The mechanical control assembly of claim 12, wherein the fixed latch pin extends from a clamp member.

* * * * *